US007716849B1

(12) United States Patent
Hicks

(10) Patent No.: US 7,716,849 B1
(45) Date of Patent: May 18, 2010

(54) GLOVE DRYER

(76) Inventor: Neil Hicks, 26 Main St., Goldens Bridge, NY (US) 10526

( * ) Notice: Subject to any disclaimer, the term of this patent is extended or adjusted under 35 U.S.C. 154(b) by 438 days.

(21) Appl. No.: 11/826,073

(22) Filed: Jul. 12, 2007

Related U.S. Application Data

(60) Provisional application No. 60/807,193, filed on Jul. 12, 2006.

(51) Int. Cl.
*F26B 25/06* (2006.01)

(52) U.S. Cl. ..... 34/104; 34/106; 34/202; 211/85.7; 211/182; D6/552

(58) Field of Classification Search ..... 34/104, 34/106, 202; D6/552; 211/85.1, 182
See application file for complete search history.

(56) References Cited

U.S. PATENT DOCUMENTS

| | | | | | |
|---|---|---|---|---|---|
| 386,746 | A | * | 7/1888 | Hess | 34/104 |
| 426,111 | A | * | 4/1890 | Coffin | 34/104 |
| 445,633 | A | * | 2/1891 | Becker | 248/165 |
| 680,264 | A | * | 8/1901 | Harrier | 34/104 |
| 684,741 | A | * | 10/1901 | Bowman | 34/107 |
| 686,314 | A | * | 11/1901 | Mansfield | 34/104 |
| 1,033,630 | A | * | 7/1912 | Sowers | 312/3 |
| 1,281,927 | A | * | 10/1918 | Felton | 34/104 |
| 1,543,829 | A | * | 6/1925 | Doyle | 223/79 |
| 1,568,078 | A | * | 1/1926 | Mabey | 223/79 |
| 1,569,283 | A | * | 1/1926 | Johnson | 223/79 |
| 1,637,488 | A | * | 8/1927 | Knopp | 34/97 |
| 1,658,882 | A | * | 2/1928 | Cantrell et al. | 248/407 |
| 2,076,735 | A | * | 4/1937 | Leindorf | 34/104 |
| 2,084,854 | A | * | 6/1937 | McCarthy | 108/31 |
| 2,336,686 | A | * | 12/1943 | Hudash | 211/33 |
| 2,465,362 | A | * | 3/1949 | Elliott | 34/104 |
| 2,481,407 | A | * | 9/1949 | Fluegel | 34/82 |
| 2,614,337 | A | * | 10/1952 | Darbo | 34/104 |
| 2,668,368 | A | * | 2/1954 | Jacobs | 34/621 |
| 2,742,956 | A | * | 4/1956 | Cannata | 297/129 |
| 2,856,700 | A | * | 10/1958 | Wales | 34/91 |
| 3,154,392 | A | * | 10/1964 | Littman | 34/104 |
| 3,203,112 | A | * | 8/1965 | Edmonds | 34/104 |
| 3,213,479 | A | * | 10/1965 | Wilkie | 15/304 |
| 3,299,529 | A | * | 1/1967 | Roberts et al. | 34/104 |
| 3,310,180 | A | * | 3/1967 | Neagle | 211/205 |

(Continued)

FOREIGN PATENT DOCUMENTS

DE 4215464 A1 * 12/1993

*Primary Examiner*—Stephen M. Gravini
(74) *Attorney, Agent, or Firm*—Donald Grant Kelly

(57) ABSTRACT

A portable, free-standing dryer device with generally tapered portions formed about a generally central axis facilitating insertion into clothing items to be dried from inside, for example gloves, mittens, socks and other substantially tubular items. The device has a connector temporarily fastening it to a forced air vent. The dryer device comprises at least first and second drier portions joined by an intermediate shoulder portion, each of which defines multiple air passages widening from inner to outer surfaces of the portions to define an expansion volume fostering air flow. A larger substantially open end in the first portion receives air from the vent. The air flows from within the drier outwardly through the passages. An angular relationship of outer surfaces of the first, second and intermediate portions relative to the device central axis ensures that the second drier portion has an extended, narrowing configuration facilitating its insertion into clothing items.

6 Claims, 1 Drawing Sheet

U.S. PATENT DOCUMENTS

| | | | | | |
|---|---|---|---|---|---|
| 3,360,871 | A | * | 1/1968 | Wattenford | 34/90 |
| 3,409,142 | A | | 11/1968 | Mechaneck | |
| 3,417,482 | A | * | 12/1968 | Peet | 34/104 |
| 3,477,622 | A | * | 11/1969 | Appelt | 223/78 |
| 3,513,564 | A | * | 5/1970 | Gramprie | 34/104 |
| 3,518,776 | A | * | 7/1970 | Wolff et al. | 34/97 |
| 3,706,824 | A | * | 2/1971 | Huber et al. | 34/104 |
| 3,566,582 | A | * | 3/1971 | Yankura | 95/219 |
| 3,589,522 | A | * | 6/1971 | Chiodo | 211/34 |
| 3,600,818 | A | * | 8/1971 | Lang et al. | 34/372 |
| 3,608,738 | A | * | 9/1971 | Andersen | 211/38 |
| 3,636,638 | A | * | 1/1972 | Noyes | 34/529 |
| 3,645,009 | A | * | 2/1972 | Ketchum | 34/104 |
| 3,662,980 | A | * | 5/1972 | Kantor et al. | 248/161 |
| 3,793,744 | A | * | 2/1974 | Saita | 34/104 |
| 3,798,788 | A | * | 3/1974 | Kuntz | 34/104 |
| 3,805,405 | A | * | 4/1974 | Ambos | 34/104 |
| 3,835,869 | A | * | 9/1974 | Newman et al. | 132/271 |
| 3,896,562 | A | * | 7/1975 | Zimmerman | 34/174 |
| 3,909,718 | A | * | 9/1975 | Allsop et al. | 294/162 |
| RE28,616 | E | * | 11/1975 | Yankura | 95/219 |
| 3,982,329 | A | * | 9/1976 | Dougherty | 34/443 |
| 3,999,304 | A | * | 12/1976 | Doty | 34/82 |
| 4,035,927 | A | * | 7/1977 | Spiegel | 34/622 |
| 4,039,774 | A | * | 8/1977 | Kata et al. | 392/384 |
| 4,085,519 | A | * | 4/1978 | Masika | 34/104 |
| 4,094,074 | A | * | 6/1978 | Schrader et al. | 34/500 |
| 4,094,076 | A | * | 6/1978 | Baslow | 34/90 |
| 4,121,351 | A | * | 10/1978 | Kapke | 34/86 |
| 4,136,464 | A | * | 1/1979 | Hay | 34/104 |
| 4,137,029 | A | * | 1/1979 | Brooks | 425/222 |
| 4,145,602 | A | * | 3/1979 | Lee | 392/382 |
| 4,171,580 | A | * | 10/1979 | Vabrinskas | 34/104 |
| 4,186,495 | A | * | 2/1980 | Remberg et al. | 34/92 |
| 4,198,765 | A | * | 4/1980 | Miyamae | 34/104 |
| 4,199,873 | A | * | 4/1980 | Hansen et al. | 34/202 |
| 4,200,993 | A | * | 5/1980 | Blanc et al. | 34/104 |
| 4,209,913 | A | * | 7/1980 | Wallin et al. | 34/442 |
| 4,253,630 | A | * | 3/1981 | Rigg | 248/346.5 |
| 4,265,030 | A | * | 5/1981 | Smallegan | 34/104 |
| 4,293,760 | A | * | 10/1981 | Smal | 219/222 |
| 4,330,946 | A | * | 5/1982 | Courneya | 34/263 |
| 4,406,071 | A | * | 9/1983 | Buchanan | 34/91 |
| 4,434,514 | A | * | 3/1984 | Sundahl et al. | 2/425 |
| 4,473,060 | A | * | 9/1984 | Bangerter | 126/101 |
| 4,506,453 | A | * | 3/1985 | Shirley et al. | 34/393 |
| 4,541,554 | A | * | 9/1985 | Endress | 223/66 |
| 4,549,053 | A | * | 10/1985 | Haugh | 219/686 |
| 4,593,179 | A | * | 6/1986 | Schulz et al. | 392/365 |
| 4,596,078 | A | * | 6/1986 | McCartney | 34/103 |
| D285,369 | S | * | 8/1986 | Sussman | D28/189 |
| 4,627,544 | A | * | 12/1986 | Scarpa et al. | 211/189 |
| 4,682,424 | A | * | 7/1987 | Irving | 34/621 |
| 4,684,787 | A | * | 8/1987 | Bunting | 219/400 |
| 4,689,897 | A | * | 9/1987 | Marsalona | 34/103 |
| D293,021 | S | * | 12/1987 | McCartney | D32/6 |
| 4,712,313 | A | * | 12/1987 | Gettleman | 34/97 |
| 4,714,445 | A | * | 12/1987 | Templeton | 446/74 |
| 4,736,527 | A | * | 4/1988 | Iwamoto et al. | 34/594 |
| 4,747,494 | A | * | 5/1988 | Tyson | 211/133.4 |
| 4,768,293 | A | * | 9/1988 | Kaffka | 34/104 |
| 4,771,708 | A | * | 9/1988 | Douglass, Jr. | 110/233 |
| 4,787,153 | A | * | 11/1988 | Chen | 34/87 |
| 4,792,071 | A | * | 12/1988 | Scarpa et al. | 223/68 |
| 4,802,287 | A | * | 2/1989 | Chen | 34/91 |
| D302,460 | S | * | 7/1989 | Gibson | D23/314 |
| 4,890,749 | A | * | 1/1990 | Walter | 211/189 |
| 4,924,604 | A | * | 5/1990 | Colodner et al. | 34/619 |
| 4,945,657 | A | * | 8/1990 | Shinn et al. | 34/128 |
| D310,742 | S | * | 9/1990 | Johnson | D32/58 |
| 4,967,060 | A | * | 10/1990 | Lomeli | 392/384 |
| 4,991,314 | A | * | 2/1991 | Allen | 34/98 |
| 4,991,756 | A | | 2/1991 | Benjamin | |
| 5,003,707 | A | * | 4/1991 | Chu | 34/104 |
| 5,014,679 | A | * | 5/1991 | Childs et al. | 126/21 A |
| 5,038,498 | A | * | 8/1991 | Woolsey | 34/225 |
| 5,058,289 | A | * | 10/1991 | Guindon | 34/104 |
| 5,068,979 | A | * | 12/1991 | Wireman et al. | 34/58 |
| 5,085,327 | A | * | 2/1992 | Mercer et al. | 211/85.7 |
| 5,115,580 | A | * | 5/1992 | Blumenfeld et al. | 34/104 |
| 5,117,565 | A | * | 6/1992 | Willenbacher, Jr. | 34/103 |
| 5,125,169 | A | * | 6/1992 | Bader | 34/103 |
| 5,140,666 | A | * | 8/1992 | Lamb | 392/382 |
| 5,157,757 | A | * | 10/1992 | McDougall | 392/383 |
| 5,159,764 | A | * | 11/1992 | Wireman et al. | 34/359 |
| 5,179,790 | A | * | 1/1993 | Poulos | 34/104 |
| 5,199,188 | A | * | 4/1993 | Franz | 34/105 |
| 5,222,308 | A | * | 6/1993 | Barker et al. | 34/104 |
| 5,243,767 | A | * | 9/1993 | Stein | 34/359 |
| 5,245,994 | A | * | 9/1993 | Chang et al. | 128/201.25 |
| 5,257,467 | A | * | 11/1993 | White | 34/618 |
| 5,287,636 | A | * | 2/1994 | Lafleur et al. | 34/104 |
| 5,289,642 | A | * | 3/1994 | Sloan | 34/104 |
| D347,094 | S | * | 5/1994 | Christensen, Jr. | D32/58 |
| 5,313,716 | A | * | 5/1994 | Wolfe | 34/90 |
| D350,633 | S | * | 9/1994 | Wong | D32/59 |
| 5,369,892 | A | * | 12/1994 | Dhaemers | 34/275 |
| 5,377,424 | A | * | 1/1995 | Albanes | 34/90 |
| 5,377,849 | A | * | 1/1995 | Martin | 211/85.7 |
| 5,379,525 | A | * | 1/1995 | Raynor | 34/104 |
| 5,406,717 | A | * | 4/1995 | Dofka | 34/104 |
| 5,412,928 | A | * | 5/1995 | Reithel | 34/104 |
| 5,467,423 | A | * | 11/1995 | Jakubowski | 392/379 |
| D365,716 | S | * | 1/1996 | Rose, Sr. | D6/552 |
| D369,139 | S | * | 4/1996 | Joder | D12/408 |
| 5,503,312 | A | * | 4/1996 | Kassner | 223/120 |
| 5,514,346 | A | * | 5/1996 | Fujita | 422/124 |
| 5,520,293 | A | * | 5/1996 | Hartley | 211/182 |
| 5,542,191 | A | * | 8/1996 | Shouse et al. | 34/104 |
| 5,546,678 | A | * | 8/1996 | Dhaemers | 34/275 |
| D374,363 | S | * | 10/1996 | Puzo | D6/552 |
| 5,570,515 | A | * | 11/1996 | Schulte | 34/104 |
| 5,592,750 | A | * | 1/1997 | Eichten | 34/104 |
| 5,596,815 | A | * | 1/1997 | Rice et al. | 34/346 |
| 5,604,993 | A | * | 2/1997 | Auckerman | 34/104 |
| 5,606,640 | A | * | 2/1997 | Murphy | 392/382 |
| 5,632,099 | A | * | 5/1997 | Seifert et al. | 34/106 |
| 5,642,462 | A | * | 6/1997 | Huff | 392/382 |
| 5,651,193 | A | * | 7/1997 | Rhodes et al. | 34/531 |
| 5,653,043 | A | * | 8/1997 | Bestwick et al. | 34/171 |
| D383,276 | S | * | 9/1997 | Janney | D32/58 |
| 5,666,742 | A | * | 9/1997 | Greve et al. | 34/218 |
| 5,685,434 | A | * | 11/1997 | Ackerman | 209/135 |
| 5,685,440 | A | * | 11/1997 | Mason | 211/189 |
| 5,702,079 | A | * | 12/1997 | MacLaren | 248/127 |
| 5,702,140 | A | * | 12/1997 | Radja | 294/146 |
| 5,720,108 | A | * | 2/1998 | Rice | 34/104 |
| D394,926 | S | * | 6/1998 | Lindsay | D32/58 |
| D394,974 | S | * | 6/1998 | Albertson et al. | D6/552 |
| 5,771,601 | A | * | 6/1998 | Veal et al. | 34/314 |
| 5,776,378 | A | * | 7/1998 | Knight | 261/30 |
| 5,791,066 | A | * | 8/1998 | Crews | 34/168 |
| 5,797,197 | A | * | 8/1998 | Alday | 34/618 |
| D398,469 | S | * | 9/1998 | Leong et al. | D6/552 |
| 5,829,160 | A | * | 11/1998 | Lange | 34/168 |
| 5,842,285 | A | * | 12/1998 | van der Veen | 34/108 |
| 5,842,287 | A | * | 12/1998 | Murphy | 34/202 |
| 5,848,716 | A | * | 12/1998 | Waranius | 211/189 |
| 5,852,879 | A | * | 12/1998 | Schumaier | 34/80 |
| 5,862,924 | A | * | 1/1999 | Dumont | 211/85.7 |
| 5,894,680 | A | * | 4/1999 | Dalvy et al. | 34/437 |
| 5,906,277 | A | * | 5/1999 | Vienneau | 206/315.1 |
| D412,381 | S | * | 7/1999 | Peet | D32/58 |
| 5,930,913 | A | * | 8/1999 | Liao et al. | 34/104 |

5,930,915 A * 8/1999 Dhaemers ..... 34/511
5,943,786 A * 8/1999 Stahley ..... 34/106
5,953,830 A * 9/1999 Jannach ..... 34/104
5,956,858 A * 9/1999 Veal et al. ..... 34/58
5,956,863 A * 9/1999 Allen ..... 34/97
5,983,518 A 11/1999 Ellenburg
5,984,680 A * 11/1999 Rogers ..... 433/173
5,987,773 A * 11/1999 Lipscy ..... 34/106
D421,866 S * 3/2000 Long ..... D6/552
6,053,337 A * 4/2000 Venegas, Jr. ..... 211/22
6,053,340 A * 4/2000 Cameron ..... 211/85.7
6,079,572 A * 6/2000 Irvin ..... 211/23
6,085,436 A * 7/2000 Peet ..... 34/104
6,130,991 A * 10/2000 Chapman ..... 392/367
6,134,806 A * 10/2000 Dhaemers ..... 34/404
6,164,465 A * 12/2000 Schroeder ..... 211/85.7
6,216,359 B1 * 4/2001 Peet ..... 34/105
6,216,887 B1 * 4/2001 Soo ..... 211/85.7
6,263,591 B1 * 7/2001 La Porte ..... 34/622
6,327,792 B1 * 12/2001 Hebert ..... 34/104
6,351,894 B1 * 3/2002 Lund et al. ..... 34/106
6,364,948 B1 * 4/2002 Austin et al. ..... 118/58
6,385,862 B1 * 5/2002 Vande Haar ..... 34/441
6,390,308 B1 * 5/2002 Ebrahim ..... 211/85.3
6,405,454 B1 * 6/2002 Kramer et al. ..... 34/586
6,516,536 B2 * 2/2003 Ryden ..... 34/106
6,553,687 B1 * 4/2003 Leamon, Jr. ..... 34/104
6,591,994 B1 * 7/2003 Bearss ..... 211/85.7
6,601,813 B1 * 8/2003 Kager et al. ..... 248/314
6,688,019 B2 * 2/2004 Buchweitz ..... 34/106
D487,831 S * 3/2004 Savoie ..... D32/58
6,742,276 B1 * 6/2004 Anderson et al. ..... 34/204
6,766,591 B1 * 7/2004 McKinney et al. ..... 34/104
6,766,594 B2 * 7/2004 DuRapau ..... 34/437
D496,502 S * 9/2004 Cheng ..... D32/8
6,802,136 B2 * 10/2004 Merchant ..... 34/104
6,820,351 B1 * 11/2004 Chesley et al. ..... 34/591
6,839,982 B1 * 1/2005 Hoover ..... 34/90
6,842,581 B2 * 1/2005 Schafer ..... 392/380
6,880,711 B2 * 4/2005 Collier ..... 211/85.7
6,918,193 B2 * 7/2005 Marolt ..... 34/104
6,922,909 B2 * 8/2005 Andrew et al. ..... 34/96
6,928,235 B2 * 8/2005 Pollack ..... 392/380
6,962,004 B2 * 11/2005 DuRapau ..... 34/104
D519,255 S * 4/2006 Peet et al. ..... D32/59
7,043,854 B2 * 5/2006 Peet et al. ..... 34/381
D525,006 S * 7/2006 Bothun et al. ..... D34/21
7,077,301 B2 * 7/2006 Dudley ..... 223/120
7,083,055 B1 * 8/2006 Ambrosat ..... 211/85.7
7,093,376 B2 * 8/2006 Regen ..... 34/96
7,103,989 B2 * 9/2006 Rosseau et al. ..... 34/104
D530,053 S * 10/2006 Bothun et al. ..... D34/17
7,121,017 B2 * 10/2006 DuRapau ..... 34/381
7,188,435 B2 * 3/2007 Woolston et al. ..... 34/381
D541,493 S * 4/2007 Peet ..... D32/8
D562,519 S * 2/2008 Palese et al. ..... D32/59
D563,070 S * 2/2008 Palese et al. ..... D32/59
D563,619 S * 3/2008 Palese et al. ..... D32/58
D565,260 S * 3/2008 Lam ..... D32/8
7,350,317 B2 * 4/2008 Matsui et al. ..... 34/96
7,360,481 B2 * 4/2008 Moon et al. ..... 99/483
D576,773 S * 9/2008 Beckett ..... D32/58
7,467,481 B2 * 12/2008 Christian ..... 34/104
7,469,487 B2 * 12/2008 Macher et al. ..... 34/104
7,484,631 B2 * 2/2009 Bothun et al. ..... 211/162
7,526,876 B2 * 5/2009 Carey et al. ..... 34/90
7,534,136 B2 * 5/2009 Bova ..... 439/537
2002/0194746 A1 * 12/2002 Lancer ..... 34/90
2004/0181963 A1 9/2004 Morris
2005/0252022 A1 * 11/2005 Tyau ..... 34/82
2006/0064892 A1 * 3/2006 Matsui et al. ..... 34/96
2006/0080857 A1 * 4/2006 Regen ..... 34/96
2006/0101662 A1 * 5/2006 Ackermann et al. ..... 34/86
2006/0201016 A1 * 9/2006 Nakagawa et al. ..... 34/96
2009/0019720 A1 * 1/2009 Grobler et al. ..... 34/365
2010/0011610 A1 * 1/2010 Bittorf et al. ..... 34/359
2010/0051058 A1 * 3/2010 Cotter et al. ..... 134/18

* cited by examiner

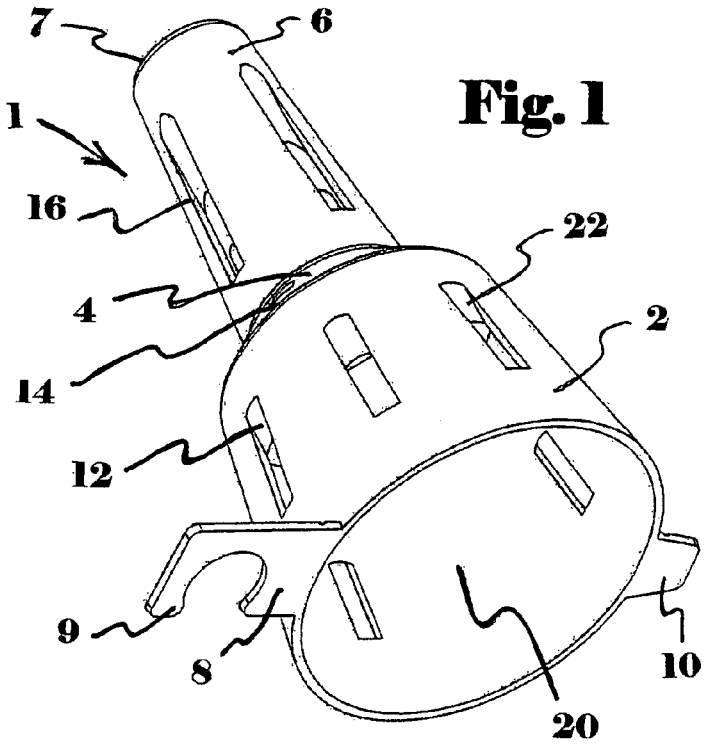
Fig. 1
Fig. 2
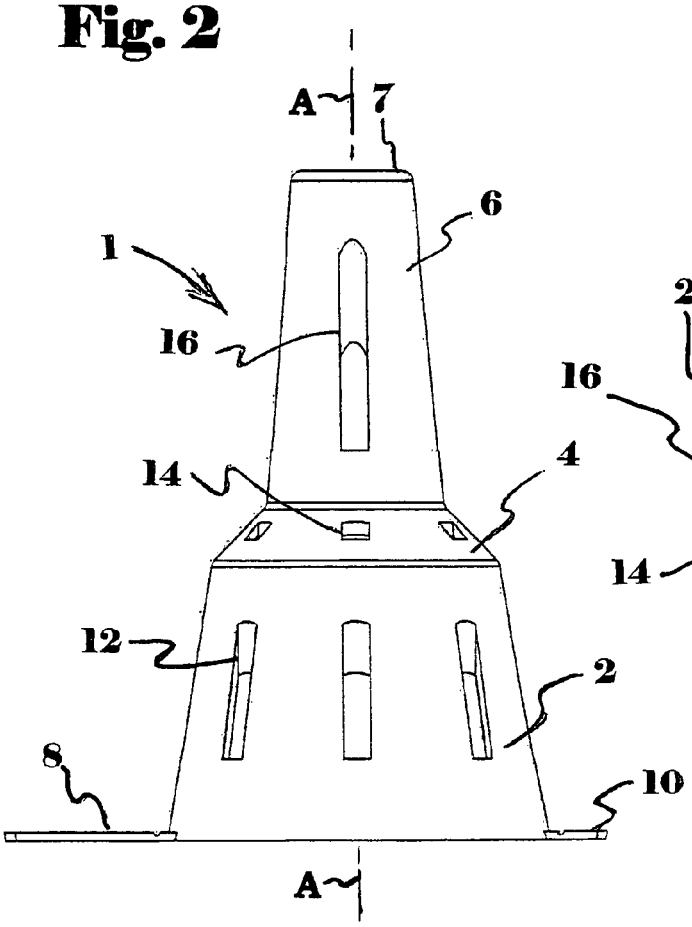
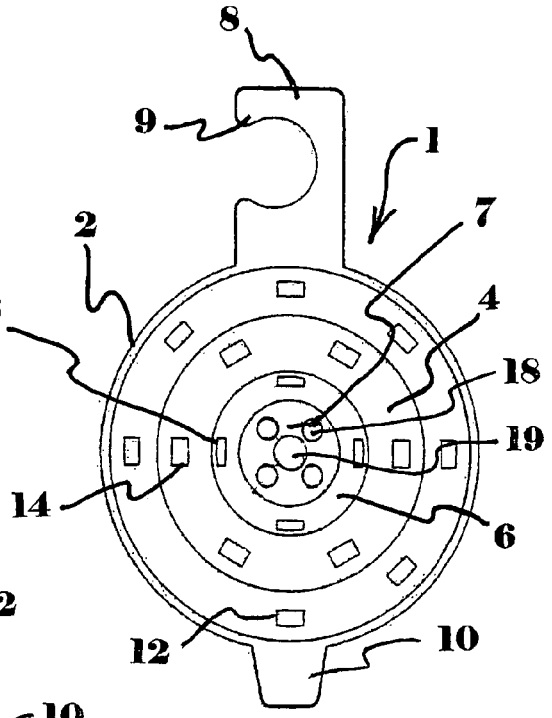
Fig. 3

GLOVE DRYER

REFERENCE TO RELATED APPLICATIONS

This application is entitled to the benefit of provisional patent application Ser. No. 60/807,193, filed Jul. 12, 2006; such benefit is hereby claimed under 35 USC 119(e), and the disclosure thereof in its entirety is hereby incorporated by reference.

STATEMENT REGARDING FEDERALLY SPONSORED RESEARCH OR DEVELOPMENT

Not Applicable

REFERENCE TO SEQUENCE LISTING

Not Applicable

BACKGROUND OF THE INVENTION

1. Field of the Invention

This invention relates to drying items such as gloves, mittens, and other garments or parts thereof. More particularly, the invention relates to a device for holding such items in a substantially open position whereby drying can occur by the flow of air therethrough.

2. Description of Related Art

Thorough drying of wet or damp articles of clothing subsequent to exposure of the articles to wet weather conditions, incidental emersion, or simply following routine laundering of the articles is important to comfort and health of the wearer. Incomplete drying can bring discomfort and chills to those individuals who must wear the articles during work or recreation.

Further, allowing damp articles of clothing to lie around for extended periods of may result in an unwelcome experience for the individual who must then wear such clothing into the cold outdoors. Items of clothing left damp and dormant for a significant period, particularly woolens or leather, quickly develop a musty scent usually found difficult to eradicate. This scent may signal the growth of mildew which ultimately may damage the clothing fabric and/or introduce allergens and/or pathogens. Examples of clothing articles most adversely impacted might include leather or woolen gloves, mittens, socks, stockings, shoes, boots or portions of jackets, slacks, caps, shirts and similar items.

A significant problem is that timely, thorough drying of such items too often is inconvenient or even impossible. Placing the items into an electric or gas heated dryer of the standard type and capacity typically assigned to handling large volumes of clothing takes considerable time and attention, and can be a waste of energy expense. Also, such treatment may result in damage (e.g., shrinkage or parching) to the items themselves. Lack of an effective alternative has driven some to desperate and even dangerous measures.

Fire department authorities repeatedly report damaging fires resulting from placement of mittens, socks or similar items in a microwave oven or their suspension from a mantel of an open fireplace. Injuries have been reported as the result of insertion of hot curling irons or other heating implements such as glowing light bulbs into the fabric of wearing apparel.

Though not usually hazardous, placement of damp clothing items on a hot radiator or against a vented outlet of a forced-air heating system can be discouragingly slow and bring disappointingly inadequate results. Heat radiated or blown against the outer surfaces of the items may tend to over-dry the surface of an item while under-drying its interior confines. Typically, this results in parched, heat-damaged surface areas while stubborn dampness continues to dwell within. Faced with the choice of wearing damp gloves, mittens or other items into the cold morning air, many elect to leave them behind. In extreme climates this can, of course, be a regrettable choice.

Over the years, a great number of devices and solutions have been proposed for facilitating the drying of damp clothing items. Each falls considerably short of expectations in a number of ways. The devices or solutions either are too expensively complex in structural design to be economically manufactured, or they simply are ineffective in application. The present invention represents a solution which is a significant step forward with respect to the prior art.

For example, Benjamin's U.S. Pat. No. 4,991,756 presents a device for drying wet gloves or mittens, or portions of other wet clothing. Benjamin's device is formed as a hollow cylinder or is slightly tapered from cylindrical to slightly conically shape. The main portion of Benjamin's dryer includes a grid of multiple ventilation holes that are square or diamond shaped to facilitate evaporation of moisture.

Benjamin's dryer device can be made of flexible plastic material and molded into its final shape (and also into such a shape that a number of said dryers can be "nested" inside each other). Alternatively, Benjamin's dryer device can be molded in an essentially planar condition and then forced by the user into its shape described above, by slight exertion of hand pressure.

The shape of Benjamin's device is such that it may be inserted into a glove or mitten so as to allow air to circulate to remove the moisture and thus dry the glove and/or its lining. At its larger end, a tab with a through-hole or S-hook is provided for hanging the dryer unit during a drying process. This device is complex in its design to the point of being difficult to fabricate economically, and results in a surface texture and shape that resists efforts to place it within damp items to be dried.

In U.S. Pat. No. 5,983,518 issued to Ellenburg, a glove drying device is described as comprising a slightly tapered shell for holding the glove, and a clamp for attaching the tapered shell to a golf cart. As the golf cart is driven, movement of the device through the surrounding air serves to dry the glove. Alternatively, the shell may be attached to a golf bag and includes a battery powered fan for drying a glove placed thereon. Applicant notes that golf carts hardly move at great speeds to effect rapid drying; wind around a golf bag will do little if any drying. Besides, the Ellenburg device is not adaptable to use by people arriving home on a cold wet night with gloves that must be dried by morning.

Auckerman's U.S. Pat. No. 5,604,993 introduces another golf glove dryer. This device includes a perforated hollow drying form in the shape of a hand. A tube is mounted to the inside of the drying form in order to improve air flow into the interior of the form. A heater is provided for mounting inside the tube in order to heat the air which flows into the drying form and to enhance the air flow. This, of course, is a single-use device requiring very specific manufacturing specifications.

Disclosed in Dofka's U.S. Pat. No. 5,406,717 is a compact drying rack for gloves. Dofka's invention includes a drain basin for fluid drip collection. Two pylons are situated within the drain basin and serve as bases for vertical, hollow support rods on which are mounted spread ring discs which engage the inside of glove surfaces to facilitate drying.

Positioning the utility gloves on Dofka's drying rack permits air drying of utility gloves thereby destroying pathogens present on wet gloves, preserves the quality of the glove material, avoids contamination to the work site by eliminating pooling of fluids on wet gloves deposited on counter tops.

Bader's U.S. Pat. No. 5,125,169 offers a relatively complex glove drying apparatus and method wherein an internal sliding mechanism includes fingers movable from retracted position to expanded position. When the fingers are in retracted position the sliding mechanism may be inserted into the glove and then expanded into glove drying position. A non-constant cross-section configuration of the fingers allows for air circulation within the gloves thus promoting drying thereof.

Like Bader's device discussed above, the Willenbacher, Jr. U.S. Pat. No. 5,117,565 illustrates a glove drying frame configured as a human hand. In this instance the drying frame is formed of a wire mesh hollow body to accommodate a glove thereon, with the hollow body mounting a support clip to a wrist portion of the hollow body to permit suspension of the hollow body permitting free-flow of drying air to be directed interiorly of the hollow body. The Willenbacher, Jr. invention further includes a mounting framework for support of a plurality of hollow bodies permitting directing of a drying medium within the hollow bodies.

Appelt's U.S. Pat. No. 3,477,622 presents a glove dryer comprising a structure simulating a hand, and which may be folded flat during non-use. Mechaneck's U.S. Pat. No. 3,409,142 discloses a glove drying stand which may be configured to dry multiple gloves. The Mechaneck dryer may stand upright on its own or be attached laterally for its support.

In Published U.S. Patent Application No. 2004/0181963, Morris shows an insert disposed in a glove to open up the glove and allow the flow of drying air to the inner surfaces of the glove. A cruciform shaped opening is provided in a central portion of the insert. The opening is adapted to interlock with a mating cruciform member on a drying tree for drying in ambient air. Alternatively, the insert with glove mounted thereon can be disposed in a gas or electric dryer.

DuRapau's U.S. Pat. No. 7,121,017 and No. 6,962,004 present drying apparatuses for boots and gloves including a body portion with an upwardly extending drying member. The member includes an upper portion for holding an item of apparel, and a platform coupled to the body portion. The platform can be moved into a first generally horizontal position over the drying member and can be moved into a second, non-horizontal position not over the drying member such that a user has access to the upper portion of the drying member. The drying apparatus can include an air freshener.

While a great number of dryers and drying methods presently exist within the prior art, all are burdened by complexity or manufacture and ineffectiveness in application. None holds the advantages of the present invention, particularly in terms of ease of placement of the dryer unit within items to be dried. Further advantages of the present invention are its simplicity and economy of manufacture, and enhanced results from its application.

BRIEF DESCRIPTION OF THE SEVERAL VIEWS OF THE DRAWINGS

FIG. 1 shows a perspective of the device as viewed from its larger, substantially open end and tapering toward a smaller substantially closed end;

FIG. 2 illustrates a side elevation of the device shown upright as it rests on its larger end;

FIG. 3 is a plan view at the larger end of the device looking into the larger substantially open end of the device, and through toward its smaller end.

DETAILED DESCRIPTION OF THE INVENTION

The present invention is a passive dryer device generally designated as 1. Dryer device 1 is both portable and free-standing, and is formed generally about a central axis A. It has a shape affording stacked shipments, and nesting storage of multiple units during non-use.

Dryer device 1 finds uniquely useful application to wearing apparel (not shown) which is, at least in part, generally tubular in shape, but of course adaptable to non-tubular shapes as well. It is important, however, that the wearing apparel item to be dried is structured to permit insertion of dryer device 1. Examples of such apparel (while in no way intended as limiting the application of dryer device 1) are gloves, mittens, socks, stockings, and the like. Other apparel items to which device 1 may be applied include shirt sleeves, certain shoe or boot designs, hats, stocking caps, and the like.

Dryer device 1 enjoys a unique configuration to facilitate its insertion for drying items from inside-out. It is formed to mount on typical heat-outlets such as a building's forced-air vents. As illustrated in FIG. 1, dryer device 1 includes a relatively larger, substantially open base or portion 2 and a relatively smaller second end or portion 6 terminating at a substantially closed end 7.

Both portions (2, 6) have an inner and outer surface substantially smooth so as to facilitate relative mounting thereupon of any items to be dried, as well as enabling nesting or stacking as discussed hereabove. An intermediate or shoulder portion 4 is configured and located so as to adjoin portions 2 and 6 and is, for the same reasons just discussed, substantially smooth in nature on both its inner and outer surfaces.

Overall, dryer device 1 presents a generally conical configuration which narrows or tapers from its relatively larger substantially open base portion 2, to its second portion 6, terminating at end 7. However, rather than a uniform tapering of the dryer device 1 from first portion to second portion (2, 6, 7), the device 1 decreases in at least two tapering stages and at differing tapering rates or angles relative to central axis A. To form a user friendly dryer configuration, the relationships of these differing angles is important as will now be explained.

Each portion (2 and 6) has an outer surface configuration defined generally by a surface of revolution about the dryer device central axis. If the surfaces of revolution of the initial portion 2 and second portion 6 were to be extended so as to intersect the device central axis A, the intersection angle of the surface of revolution extension for portion 2 will be greater relative to that of portion 6. The general effect is that the dryer device 1 of the present invention presents a narrowed axial extension toward its end 7 as is evident in FIGS. 1 and 2.

This narrowed axial extension in the form of portion 6 facilitates its easy insertion into even the smallest item of apparel such as a child's mitten. (Note: While the expressions "generally conical" and "surface of revolution" are, for convenience of explanation and understanding, employed in describing this invention, it will be apparent that any equivalent shape such as "generally polygonal" will apply just as well, with tapering reductions in width following the same basic scheme to be described below.)

Between (and interconnecting) the first portion 2 and second portion 6 is a generally annular transition section or shoulder 4. This narrowing transition section, shoulder 4, also has an outer surface configuration defined generally by a surface of revolution about the dryer device 1 central axis. If the surface of revolution of shoulder 4 were to be extended so as to intersect the device 1 central axis A, it would do so at an angle greater than that of both the first and second portions 2 and 6. This shoulder 4 configuration serves to step-up the support surface for ever-larger items of clothing and the like, as end 7 is inserted relatively deeper into the apparel item.

Each of the portions 2, 4, and 6 (as well as end 7) is provided with a set of air passages, 12, 14, 16 and 18 respectively. Compared to prior art devices, the number of air passages in the portions 2, 4 and 6 is relatively minimal. By limiting the collective (or sum of), substantially open areas in each said first, second and intermediate dryer portion 2, 4 and 6 to less than half of each said portion collective surface area, the resultant device 1 structure will be substantially rigid and stable, and notably more easily inserted into clothing items without deforming.

In the present context, "collective open area" refers to the square-inch sum of open areas for a portion 2, 4 or 6. Similarly, "collective surface area" refers to the total overall surface area for each portion 2, 4 or 6. It will be appreciated that air forced through fewer openings relative to overall surface area of a dryer device will flow with substantially increased back pressure than in a device where the vast majority of the surface area is effectively divided into a comparably greater number of adjacent passages.

Passages 12, 14, 16 are bordered by their smooth and uninterrupted edges to avoid snagging the material or fabric of items mounted thereon. As more clearly illustrated in FIG. 3, passages 12, 14 and 16 are further defined so as to slightly expand in volume capacity from an inside surface toward outside surface of each portion (2, 4, 6) of device 1.

During use of dryer device 1, air may be forced from a typically heating duct so as to flow into opening 20. The air then is moved in a continuously reduced pathway toward and into the shoulder portion and second portion, respectively. Along its pathway of flow, the air is forced through passages 12, 14 and 16, as well as through holes 18 in end 7, and into an interior of any clothing item mounted thereon. (Note: The circle labeled 19 in FIG. 3 is not a hole, but rather a depression resulting from the molding process.)

The defined perimeter of each passage 12, 14 and 16 at its innermost area at dryer device 1 inner surface is smaller than its defined outermost perimeter at dryer device 1 outer surface. In other words, said passages are defined and configured to broaden or expand in volume from the inner surface to said outer surface of each dryer 1 portion (2, 4, and 6).

At a downstream edge of each passage 12, 14 and 16 is a fillet surface 22 formed to define the expanding volume. (Fillets 22 blend with smooth downstream edges of each passage so as to further avoid snagging engagement with items being dried.) Volume expansion of passages 12, 14 and 16 and the attendant reduction of air pressure toward the outside surface of the device 1 serves to foster escape of the moving air from inside to outside of the device 1. As the moving air progresses through device 1 and outwardly through passages 12, 14, 16 and 18, it impinges against the damp interior confines of a clothing item.

As mentioned above, the overall shape of dryer device 1 presents a distinct advantage when mounting a damp item thereon. As the item and dryer device 1 are moved relatively into juxtaposition, the leading smaller portion 6 enters relatively easily into an item interior portion, regardless of the item size or dampened condition.

With further relative movement, the smaller portion 6 works its way deeper into the damp clothing item so as to encourage the item to move relative to dryer 1 shoulder portion 4 and still further onto larger portion 2. Of course, smaller items (such as an infant's mitten) may not make it beyond initial insertion of smaller portion 6.

Further, it should be noted that the present invention may be constructed with more than the two portions 2 and 6 discussed above. For example, an additional portion may follow shoulder 4, and be configured with a tapered step-down to another shoulder joining an even more reduced portion 6.

Permitting or directing forced air from heating vents (or the air flow resulting from the rising heat flow from radiator units) into the larger end portion 2 of the inventive drying device 1 facilitates a safe, efficient and effective drying process—progressing from clothing item inside toward item outside. The device is configured to accept a range of apparel sizes from infant to adult. Further, there is no power consumption issue or danger of ignition or electrical short from passive device 1.

Advantageously, dryer device 1 further includes a vent-connection feature in the form of utility extension 8 having a connector element 9, and a stabilizing extension tab 10. Connector element 9 and tab 10 are located generally adjacent opening 20 of the larger portion 2, and each could take any of a variety of equivalent configurations. In operation, dryer device 1, with its mounted clothing item may be placed upon an air vent outlet such that extension connector 9 releasably attaches to a portion of vent structure (e.g., vent flow control lever or vent slot).

If needed for device 1 stabilization, the extension tab 10 may first be wedged or pressed within one of the vent slots and the device 1 subsequently attached via connector 9. In cases where a facility's air flow vent is substantially horizontal or flat, the two extensions 8 and 10 can serve as "feet" to stabilize the dryer device 1 as it resides upon the vent with its smaller portion 6 extending upwardly. Tab 10 may further serve as a labeling point to associate the clothing items (e.g., ski gloves) with their owner.

Words and expressions employed herein are used as terms of description, not of limitation. There is no intention in the use of such terms and expressions of excluding any equivalents of the features shown and described or portions thereof. It is to be recognized, therefore, that various modifications are possible within the scope and spirit of the invention. Accordingly, the invention incorporates variations that fall within the scope of the following claims.

I claim:

1. A generally conical dryer device for drying items of clothing, said generally conical dryer device formed about a generally central axis and comprising:

at least a first dryer portion, said first dryer portion having an outer and an inner surface, and a set of air passages extending therethrough;

the outer surface of said first dryer portion extending at a first angle to said axis;

said first dryer portion further including a first substantially open end for receiving an air flow;

at least a second dryer portion, said second dryer portion having an outer and an inner surface, and a set of air passages extending therethrough;

the outer surface of said second dryer portion extending at a second angle to said axis, said second angle being smaller than said first angle;

said second dryer portion having a substantially open end receiving an air flow from said first dryer portion;

said second dryer portion further having an additional end inserting into clothing items to be dried;

an intermediate dryer shoulder portion interconnecting said first and said second dryer portion, said intermediate dryer portion having an outer and an inner surface, and a set of air passages extending therethrough;

the outer surface of said intermediate dryer portion extending at a third angle to said axis, said third angle being greater than each of said first and second angle defining said shoulder;

said intermediate dryer portion further including a substantially open end receiving air from said first dryer portion and a further substantially open end passing air flow to said second dryer portion;

whereby said dryer device tapers from a larger, substantially open first end to a smaller second end enabling said dryer to fit within articles of clothing such that forced air flowing into the dryer first portion substantially open first end moves in a reduced pathway toward and into said dryer second portion and escapes outwardly through said sets of air passages and into an interior of a clothing item supported thereby.

2. The dryer device of claim 1 further distinguished by:

said passages are configured to broaden from the inner surfaces to said outer surfaces;

whereby a volume expansion results and the attendant reduction of air pressure toward an outside surface of the dryer device serves to foster escape of air from inside to outside of the device where it impinges the interior of the clothing item.

3. The dryer device of claim 1 further distinguished by:

said first substantially open end of said first dryer portion further including a connector element configured to interconnect to an air flow vent;

whereby said dryer device may be attached directly to an air flow vent and receive flowing air into its first substantially open end for distribution through the passages.

4. The dryer device of claim 3 further distinguished by:

said first substantially open end of said first dryer portion further including a stabilizing tab.

5. The dryer device of claim 1 further distinguished by:

said additional end of said second dryer portion having outlet holes therein directing air flow into a clothing item to be dried thereby.

6. The dryer device of claim 1 further distinguished by:

each said first, second and intermediate dryer portion has a collective outer surface area defining therein substantially open areas in the form of said passages;

a sum of all said substantially open areas defined for each said portion comprises less than half the collective outer surface area of each said portion;

whereby the drier device is substantially rigidly stable and thus more easily inserted into clothing items without deforming.

* * * * *